US006112914A

United States Patent [19]

Naficy

[11] Patent Number: 6,112,914

[45] Date of Patent: Sep. 5, 2000

[54] METHOD AND APPARATUS FOR HANGING WINDOW COVERINGS FOR CLEANING PURPOSES

[76] Inventor: Anne-Marie Naficy, 3 Da Vinci St., Lake Oswego, Oreg. 97035

[21] Appl. No.: 09/145,052

[22] Filed: Sep. 1, 1998

[51] Int. Cl.[7] ..... A47F 5/00

[52] U.S. Cl. ..... 211/113; 211/118; 248/327; 248/205.2; 15/268

[58] Field of Search ..... 15/268; 211/117, 211/118, 113; 248/205.2, 317, 327; 24/306

[56] References Cited

U.S. PATENT DOCUMENTS

| | | | |
|---|---|---|---|
| D. 367,389 | 2/1996 | Cole et al. . | |
| 2,588,557 | 3/1952 | Morris et al. . | |
| 2,875,971 | 3/1959 | Burns . | |
| 2,996,747 | 8/1961 | Iori . | |
| 3,130,439 | 4/1964 | Bovaird . | |
| 3,197,797 | 8/1965 | Stanley . | |
| 3,610,426 | 10/1971 | Thomas | 211/117 |
| 4,277,861 | 7/1981 | Lex . | |
| 4,759,963 | 7/1988 | Uso et al. | 248/205.2 X |
| 4,878,274 | 11/1989 | Patricy | 24/306 |
| 4,879,782 | 11/1989 | Jacobson . | |
| 4,934,015 | 6/1990 | Mink | 15/268 |
| 5,027,960 | 7/1991 | Rainville | 211/118 |
| 5,032,187 | 7/1991 | Lawless . | |
| 5,056,184 | 10/1991 | Pitchford . | |
| 5,075,933 | 12/1991 | Kemper | 24/306 X |
| 5,131,118 | 7/1992 | Breeher | 24/306 |
| 5,201,100 | 4/1993 | Cardinale | 24/306 |

*Primary Examiner*—Robert W. Gibson, Jr.
*Attorney, Agent, or Firm*—Blakely Sokoloff Taylor & Zafman, LLP

[57] ABSTRACT

The present invention beneficially provides an improved method and apparatus for cleaning window coverings. The apparatus comprises a flexible strip and a hanging unit. The flexible strip engages a portion of a window covering and includes a fastening feature to secure the flexible strip to the portion of the window covering. The hanging unit couples with the flexible strip and a support structure, wherein the hanging unit and the flexible strip can support at least part of the weight of the window covering when hanging from the support structure. The method comprises hanging the window covering from a support structure using the apparatus. In one embodiment, the window covering is removed from a window frame, hung from a support structure using the apparatus, washed, rinsed, allowed to dry, and repositioned in the window frame.

11 Claims, 3 Drawing Sheets

METHOD AND APPARATUS FOR HANGING WINDOW COVERINGS FOR CLEANING PURPOSES

BACKGROUND OF THE INVENTION

FIELD OF THE INVENTION

The present invention pertains to the field of window coverings. More particularly, this invention relates to the art of cleaning window coverings.

BACKGROUND

Cleaning window coverings is a chore dreaded by most people. In particular, horizontal blinds, such as venetian blinds, can be very difficult and time consuming to clean. Unfortunately, horizontal blinds tend to need cleaning frequently. For instance, the horizontal surfaces on the blinds quickly collect dust, and due to temperature variations near windows, condensation can turn the dust into muddy blotches that, once dried on, cannot be easily removed, and often require scrubbing with soap and water. Cleaning each individual horizontal blind with soap and water, and rinsing each blind, while the window covering is positioned in the window frame, can be very messy work, getting dirty water on the floor, the window, the window sill, the surrounding wall, nearby furniture, etc. Moreover, scrubbing on a window cover while it is positioned in a window frame may even be dangerous, especially for tall windows.

Thus, a need exists for an improved method and apparatus for cleaning window coverings.

SUMMARY OF THE INVENTION

The present invention beneficially provides an improved method and apparatus for cleaning window coverings. The apparatus comprises a flexible strip and a hanging unit . The flexible strip engages a portion of a window covering and includes a fastening feature to secure the flexible strip to the portion of the window covering. The hanging unit couples with the flexible strip and a support structure, wherein the hanging unit and the flexible strip can support at least part of the weight of the window covering when hanging from the support structure. The method comprises hanging the window covering from a support structure using the apparatus. In one embodiment, the window covering is removed from a window frame, hung from a support structure using the apparatus, washed, rinsed, allowed to dry, and repositioned in the window frame.

BRIEF DESCRIPTION OF THE DRAWINGS

Examples of the present invention are illustrated in the accompanying drawings. The accompanying drawings, however, do not limit the scope of the present invention. Like references in the drawings indicate similar elements.

DETAILED DESCRIPTION

In the following detailed description, numerous specific details are set forth in order to provide a thorough understanding of the present invention. However, those skilled in the art will understand that the present invention may be practiced without these specific details, that the present invention is not limited to the depicted embodiments, and that the present invention may be practiced in a variety of alternate embodiments. In other instances, well known methods, procedures, and components have not been described in detail.

Figure 1:
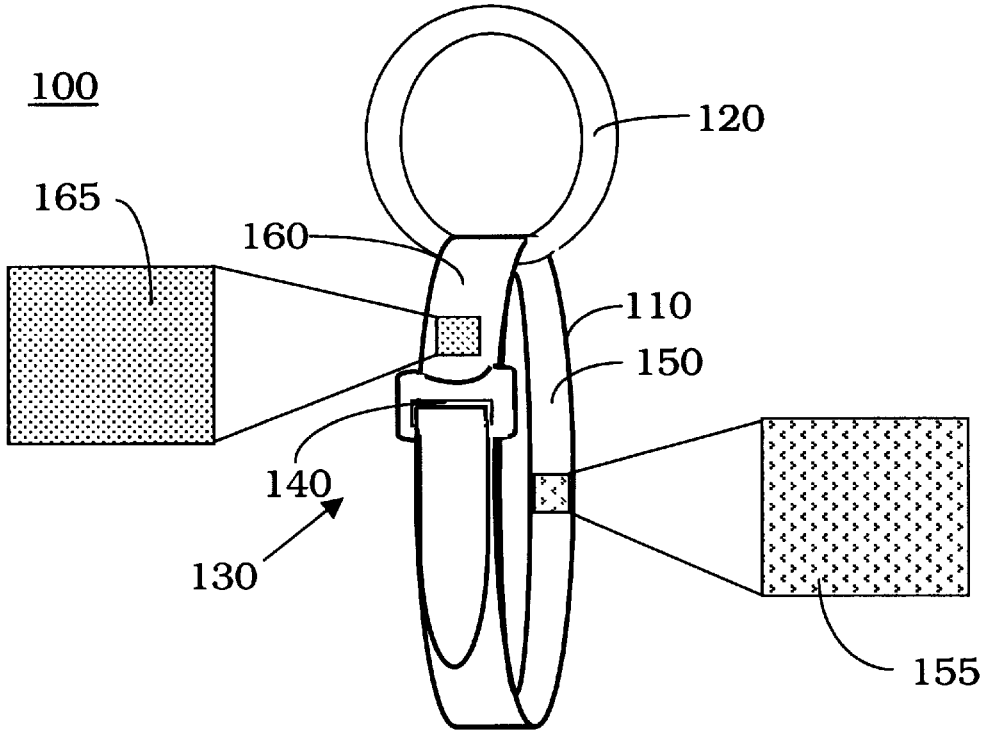
FIG. 1 illustrates one embodiment of the present invention.

FIG. 1 illustrates one embodiment of a window covering cleaning accessory 100 according to the teachings of the present invention. Cleaning accessory 100 includes flexible strip 110, hanging unit 120, and fastening feature 130. As discussed below, flexible strip 110 can engage a portion of a window covering by encircling the portion of the window covering. Then, fastening feature 130 can secure flexible strip 110 in place.

In the illustrated embodiment, fastening feature 130 includes slot 140, located near one end of flexible strip 110, and surfaces 150 and 160. When flexible strip 110 engages a portion of a window covering, an end of flexible strip 110 can be threaded through slot 140 and pulled to cinch flexible strip 110 around the portion of the window covering. Surface 150 covers one entire side of flexible strip 110, and it is comprised of numerous tiny hooks 155. Surface 160 covers the other entire side of flexible strip 110, and it is comprised of a fuzzy material 165. When flexible strip 110 wraps around the portion of the window covering, surfaces 150 and 160 come into contact, and hooks 155 removably and securely fasten into fuzzy material 165. An example of surfaces 150 and 160 is Velcro.

Alternate embodiments may not include slot 140, and surfaces 150 and 160 may only cover parts of the sides of flexible strip 110. Flexible strip 110 is shown coupled to hanging unit 120. In certain embodiments, hanging unit 120 is formed of a rigid material, such as plastic, metal, or wood. As discussed below, the rigid nature of hanging unit 120 allows it to extend away from the window covering when flexible strip 110 is secured in place, making it easier to hang from a support structure.

Figure 2:
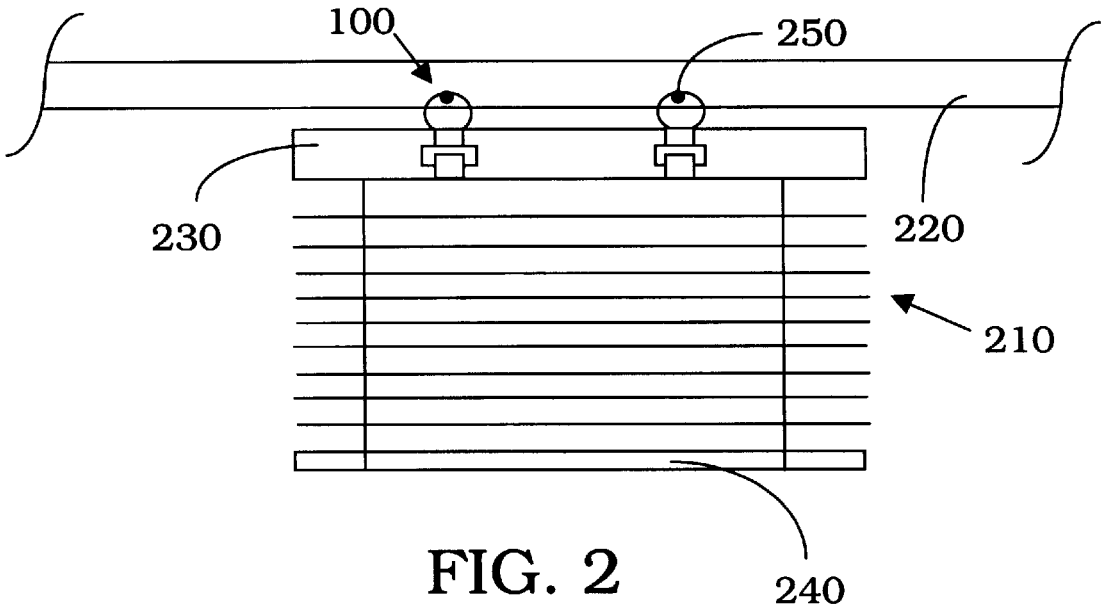
FIG. 2 illustrates a pair of cleaning accessories supporting a window covering.

FIG. 2 illustrates a pair of cleaning accessories 100 to cooperatively hang window covering 210 from support structure 220. Window covering 210 includes upper housing 230 and take-up plate 240. As shown, cleaning accessories 100 are secured around upper housing 230. In alternate embodiments, cleaning accessories 100 may be secured around take-up plate 240 wherein, for instance, cleaning accessories 100 are secured to window covering 210 before window covering, 210 is removed from its window frame.

Support structure 220 includes two protrusions 250 from which hanging units 120 of cleaning accessories 100 hang. Support structure 220 may be the top of a garage door opening, an eave of a roof line, a wall, or any other structure strong enough to support the weight of window covering 210 and appropriately located to allow window covering 210 to be cleaned. Protrusions 250 may be nails, hooks, screws, or any other protrusion over which hanging units 120 can fit and which are strong enough to support window covering 210.

Window covering 210 may be a horizontal blind assembly, such as a venetian blind. The individual blinds may be made of wood, plastic, or metal. The size of window covering 210 may vary from fairly small, covering only a few square feet when extended, to quite large, covering over one-hundred square feet when extended. Support structure 220, protrusions 250, and the number of cleaning accessories 100 can be selected based on the size and weight of window covering 210.

When hanging units 120 are made of rigid material, hanging units 120 can extend up when flexible strips 110 are secured in place. In which case, when a person is using both hands to lift window covering, 210 up to support structure 220, the person can beneficially loop hanging units 120 over protrusions 250 without removing his or her hands from window covering 210.

Figure 3:
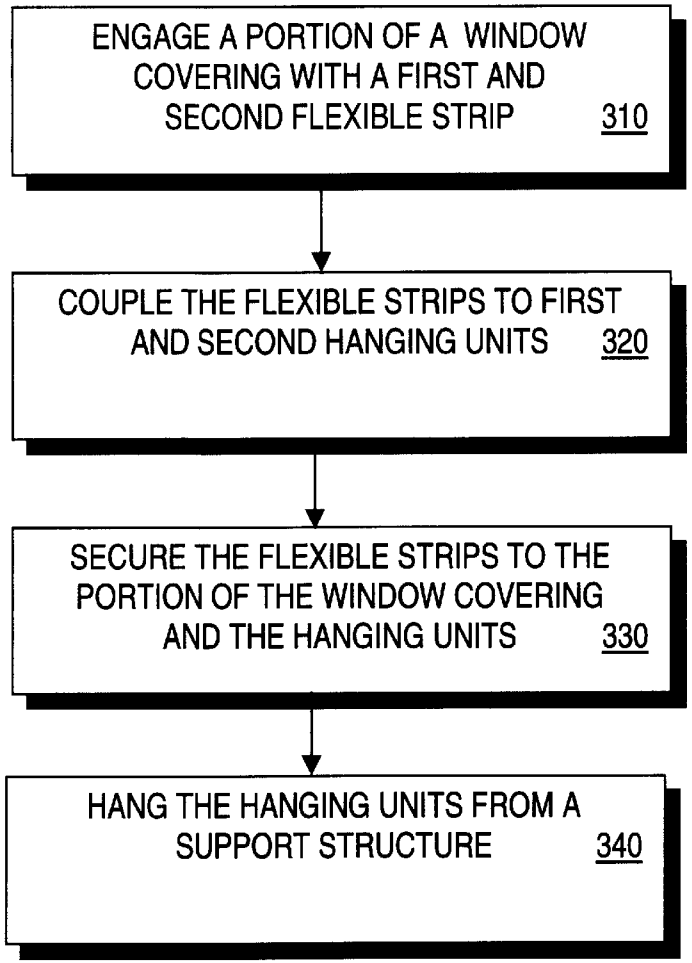
FIG. 3 demonstrates one embodiment of hanging a window covering with a pair of cleaning accessories.
Figure 5:
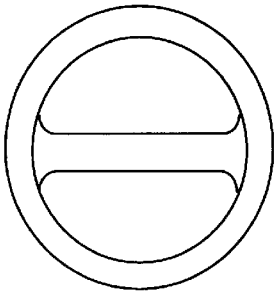
FIGS. 5–11 illustrate alternate embodiments of components of the present invention.
Figure 6:
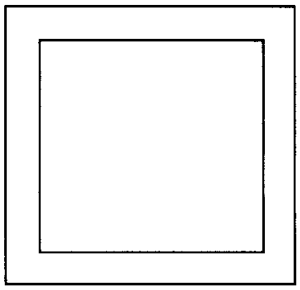
Figure 7:
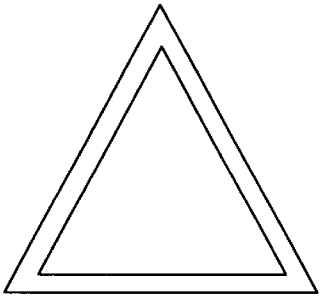
Figure 8:
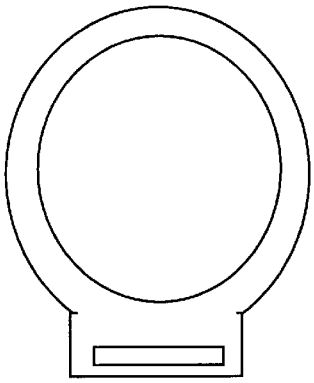
Figure 9:
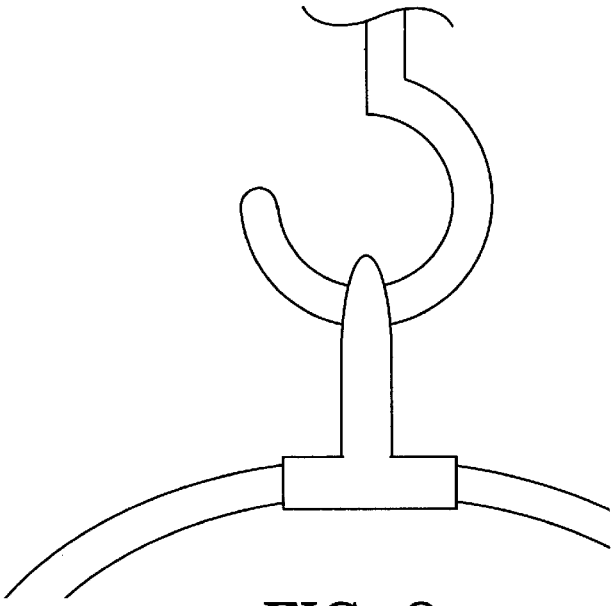

FIG. 3 demonstrates one embodiment of hanging a window covering with two cleaning accessories 100. First, in step 310, a portion of the window covering is engaged with a first flexible strip 110 and a second flexible strip 110. As illustrated in FIG. 2 above, the flexible strips may be wrapped around an upper housing toward opposite ends of the housing. Similarly, the flexible strips may be wrapped around a take-up plate, in which case the window covering can be hung upside-down. In step 320, hanging units 120 are coupled to the flexible strips. For instance, flexible strips 110 may loop through an opening in each hanging unit 120. In step 330, fastening features 130 secure the flexible strips to the window covering and the hanging units. Then, in step 340, hanging units 120 are hung from support structure 220. As discussed above, where hanging units 120 are made of rigid material, window covering 220 may be hung more easily.

Figure 4:
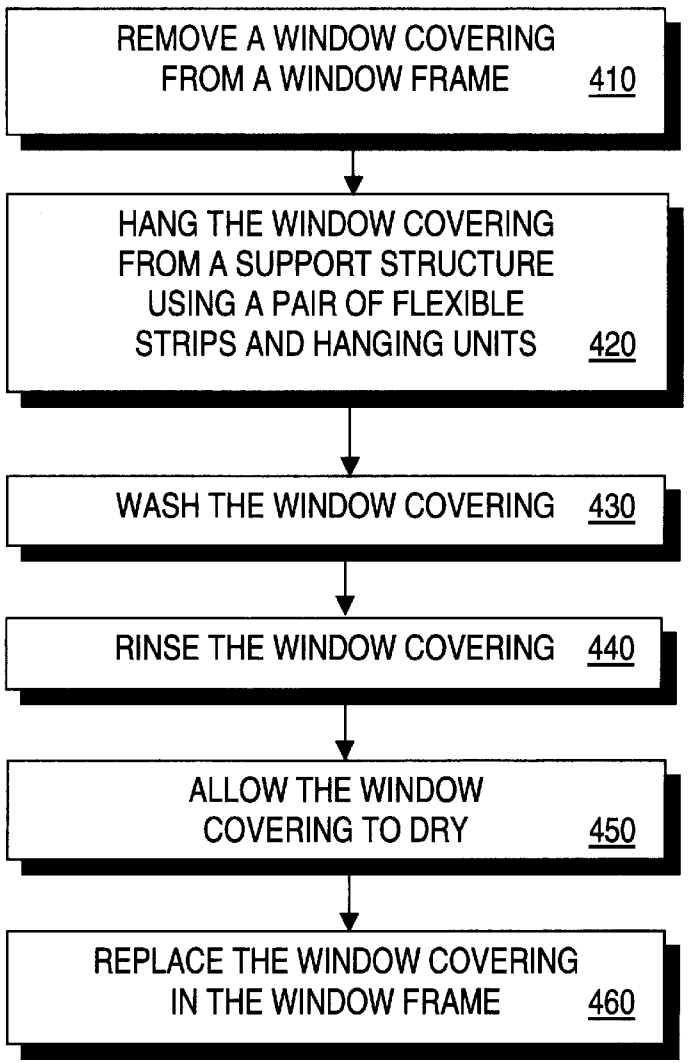
FIG. 4 demonstrates one embodiment of cleaning a window covering using a pair of cleaning accessories.

FIG. 4 demonstrates one embodiment of the entire cleaning process. First, in step 410, window covering 210 is removed from its window frame. For venetian blinds, this involves opening clips at the left and right ends of the top housing. In step 420, the window covering is hung from support structure 220 using a pair of cleaning accessories 100. The window covering is washed in step 430. For instance, where the window covering is hung from a garage door frame, the window covering can be safely scrubbed down with soapy water without being concerned about dirty water runoff or falling through a window pane. In step 440, the window covering is rinsed. For instance, when hanging from the garage door frame, the window covering can be hosed down with a garden hose. In step 450, the window covering is allowed to dry. In the garage door example, washing blinds on a sunny day may make the process faster. Once the window covering is dry, it is replaced in its frame in step 460. Again, for venetian blinds, this is as easy as closing clips at either end of the top housing.

FIGS. 5–9 illustrates possible alternate embodiments of hanging unit 120. Various additional alternate embodiments will be comprehended by one skilled in the art after having read the foregoing description.

Figure 10:
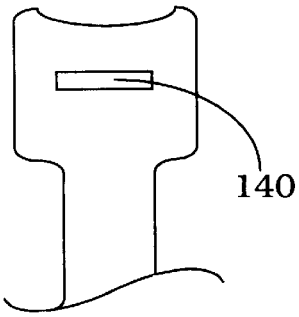
Figure 11:
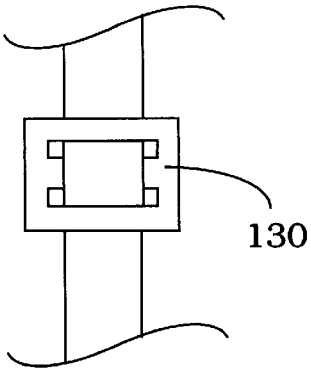

FIG. 10 illustrates one embodiment of slot 140 in flexible strip 110 in more detail. FIG. 11 illustrates one possible alternate embodiment of fastening feature 130 comprising a two-slotted tensioner. Various additional alternate embodiments will be comprehended by one skilled in the art after having read the foregoing description.

Thus, an improved method and apparatus for cleaning window coverings is described. Whereas many alterations and modifications of the present invention will be comprehended by a person skilled in the art after having read the foregoing description, it is to be understood that the particular embodiments shown and described by way of illustration are in no way intended to be considered limiting. Therefore, references to details of particular embodiments are not intended to limit the scope of the claims.

What is claimed is:

1. A set of window covering cleaning accessories comprising:

a hanging unit; and a flexible strip to engage a portion of a window covering and said hanging unit, the flexible strip including a fastening feature to removably secure the flexible strip to the portion of the window covering and the hanging unit, said hanging unit to extend fixedly outwardly from the portion of the window covering when the flexible strip is secured to the portion of the window covering, and said hanging unit to couple the flexible strip and the window covering combination to a support structure.

2. The set of window covering cleaning accessories of claim 1 wherein the window covering comprises a horizontal blind assembly, the horizontal blind assembly comprising at least one of wood, plastic, and metal horizontal blinds.

3. The set of window covering cleaning accessories of claim 1 wherein the portion of the window covering comprises one of a top housing and a bottom take-up plate.

4. The set of window covering cleaning accessories of claim 1 wherein the flexible strip is to engage the portion of the window covering by encircling the portion of the window covering, wherein the fastening feature is to secure the flexible strip around the portion of the window covering.

5. The set of window covering cleaning accessories of claim 4 wherein the fastening feature comprises:

a first side of the flexible strip, the first side comprising a plurality of hooks; and a second side of the flexible strip, the second side comprising a fuzzy material, wherein when the flexible strip encircles the portion of the window covering, at least a portion of the plurality of hooks snag at least a portion of the fuzzy material to secure the flexible strip around the portion of the window covering.

6. The set of window covering cleaning accessories of claim 4 wherein the fastening feature comprises:

at least one slot coupled with the flexible strip wherein an end of the flexible strip is to slide into the slot to cinch the flexible strip around the portion of the window covering.

7. The set of window covering cleaning accessories of claim 4 wherein the flexible strip engages the hanging unit by encircling a portion of the hanging unit.

8. The set of window covering cleaning accessories of claim 1 wherein the hanging unit comprises a rigid structure having at least one opening, said opening having a size suitable to engage a protrusion of said support structure.

9. The set of window covering cleaning accessories of claim 8 wherein the hanging unit comprises one of a ring shape, a rectangular frame, a triangular frame, and a figure eight frame.

10. The set of window covering cleaning accessories of claim 1 wherein the support structure comprises a protrusion from at least one of a garage door frame, an eave of a roof, and a wall, the protrusion comprising at least one of a nail, a hook, and a screw.

11. The set of window covering cleaning accessories of claim 1 further comprising a plurality of the flexible strips and a plurality of the hanging units to cooperatively retain the window covering from the support structure.

* * * * *